US006937205B2

(12) United States Patent
Chou et al.

(10) Patent No.: US 6,937,205 B2
(45) Date of Patent: Aug. 30, 2005

(54) INTEGRAL STRUCTURE INCLUDING AN ANTENNA AND A SHIELDING COVER AND WIRELESS MODULE THEREOF

(75) Inventors: Chen-Wang Chou, Lujou (TW); Yu-Shih Wang, ChungHo (TW)

(73) Assignee: Uniwill Computer Corporation (TW)

( * ) Notice: Subject to any disclaimer, the term of this patent is extended or adjusted under 35 U.S.C. 154(b) by 0 days.

(21) Appl. No.: 10/411,215

(22) Filed: Apr. 11, 2003

(65) Prior Publication Data

US 2004/0135733 A1 Jul. 15, 2004

(30) Foreign Application Priority Data

Jan. 13, 2003 (TW) ..... 92100656 A

(51) Int. Cl.[7] ..... H01Q 11/14
(52) U.S. Cl. ..... 343/841; 439/607
(58) Field of Search ..... 343/841

(56) References Cited

U.S. PATENT DOCUMENTS

| | | | | |
|---|---|---|---|---|
| 5,365,246 | A | 11/1994 | Rasinger et al. | |
| 5,835,063 | A | 11/1998 | Brachat et al. | |
| 6,133,886 | A | 10/2000 | Foriello et al. | |
| 6,252,552 | B1 | 6/2001 | Tarvas et al. | |
| 6,337,666 | B1 * | 1/2002 | Bishop | 343/795 |
| 6,342,860 | B1 | 1/2002 | Haussler et al. | |
| 6,392,603 | B1 | 5/2002 | Kurz et al. | |
| 6,614,405 | B1 * | 9/2003 | Mikkonen et al. | 343/872 |
| 2002/0135525 | A1 | 9/2002 | Morihiko et al. | |

FOREIGN PATENT DOCUMENTS

| | | |
|---|---|---|
| DE | 199 51 371 | 5/2001 |
| EP | 0714151 A1 | 5/1996 |
| EP | 1033821 A2 | 9/2000 |
| WO | WO-02073738 A1 | 9/2002 |

* cited by examiner

*Primary Examiner*—James Vannucci
(74) *Attorney, Agent, or Firm*—Connolly Bove Lodge & Hutz LLP; Larry J. Hume

(57) ABSTRACT

The present invention reveals an integral structure including an antenna and a shielding cover as well as its wireless module. The integral structure including an antenna and a shielding cover comprises an antenna, a shielding cover, a first conducting plate and a second conducting plate, where the antenna is used for signal transmitting and receiving, and the shielding cover can avoid electromagnetic interferences to a wireless product. The first conducting plate connects the antenna and the shielding cover. One end of the second conducting plate is connected to the feed-in point of the antenna, and the other end of that is electrically connected to a circuitry of a wireless product for signal transferring. Besides being directly installed in the wireless product, the integral structure including an antenna and a shielding cover can be equipped with a printed circuit board and a plug as a module first, and then the module can be connected to an interface of the wireless product for signal transferring.

17 Claims, 7 Drawing Sheets

INTEGRAL STRUCTURE INCLUDING AN ANTENNA AND A SHIELDING COVER AND WIRELESS MODULE THEREOF

BACKGROUND OF THE INVENTION (A) Field of the Invention

The present invention is related to an integral structure including an antenna and a shielding cover and its wireless module. More specifically, the antenna of the integral structure including an antenna and a shielding cover is built in a wireless module or a wireless communication product.

(B) Description of Related Art

With the development of wireless communication, cellular phones are becoming necessities for current communication, and WLANs (Wireless Local Area Network) are gradually replacing cable networks. Additionally, various types and categories of wireless apparatuses of WLAN or Bluetooth are widely applied in wireless keyboards, wireless mice and various IA (Information Application) products currently. In other words, current wireless products are becoming necessities of human life.

The above mentioned wireless communication products have to equip antennas for signal transmitting and receiving. If electromagnetic interferences (EMI) occur, the signal transmitting and receiving of the antennas will be seriously impacted. Additionally, the influences and injuries of the electromagnetic waves generated from wireless communication products to the human body are widely discussed recently. Therefore, constraining the injuries towards human body and the influences of communication quality due to electromagnetic waves are critical for designers.

Wireless communication products use electromagnetic waves to transmit signals. However, the electromagnetic waves generated from the wireless communication products themselves may probably impact the communication quality or be harmful to human bodies. Therefore, it is difficult to simultaneously keep the communication quality of the wireless products while avoiding electromagnetic waves.

Furthermore, most of the antennas are installed outside the wireless communication products, which may hamper the operations of users and be out of the stream of downsizing electronic products.

SUMMARY OF THE INVENTION

The main objective of the present invention is to provide an integral structure including an antenna and a shielding cover of wireless products and its wireless module, which can constrain EMI to enhance signal transmitting and receiving qualities and reduce the influences of electromagnetic waves to human bodies.

Another objective of the present invention is to provide a built-in antenna for a wireless module and a wireless product to meet the requirement of downsizing electronic products.

The integral structure including an antenna and a shielding cover for a wireless product of the present invention includes an antenna, a shielding cover, a first conducting plate and a second conducting plate, of which the antenna is for signal transmitting and receiving, and the shielding cover can avoid electromagnetic interferences of a wireless product. The first conducting plate connects the antenna and the shielding cover. One end of the second conducting plate connects the feed-in point of the antenna, and the other end of that is electrically connected to a circuitry of the wireless product for signal transferring.

The first conducting plate connects the ends of the antenna and the shielding cover, and the antenna is longitudinally spaced at a distance to the shielding cover.

The integral structure including an antenna and a shielding cover can be soldered to a printed circuit board of a wireless product to form a wireless module, which induces the antenna electrically connected to the printed circuit board. Additionally, a plug, such as a USB (Universal Serial Bus) plug for example, can be equipped on the printed circuit board to be connected to an interface of the wireless product for signal transferring.

DETAILED DESCRIPTION OF THE INVENTION

An integral structure including an antenna and a shielding cover using 2.4 GHz Bluetooth is exemplified as follows.

Figure 1:
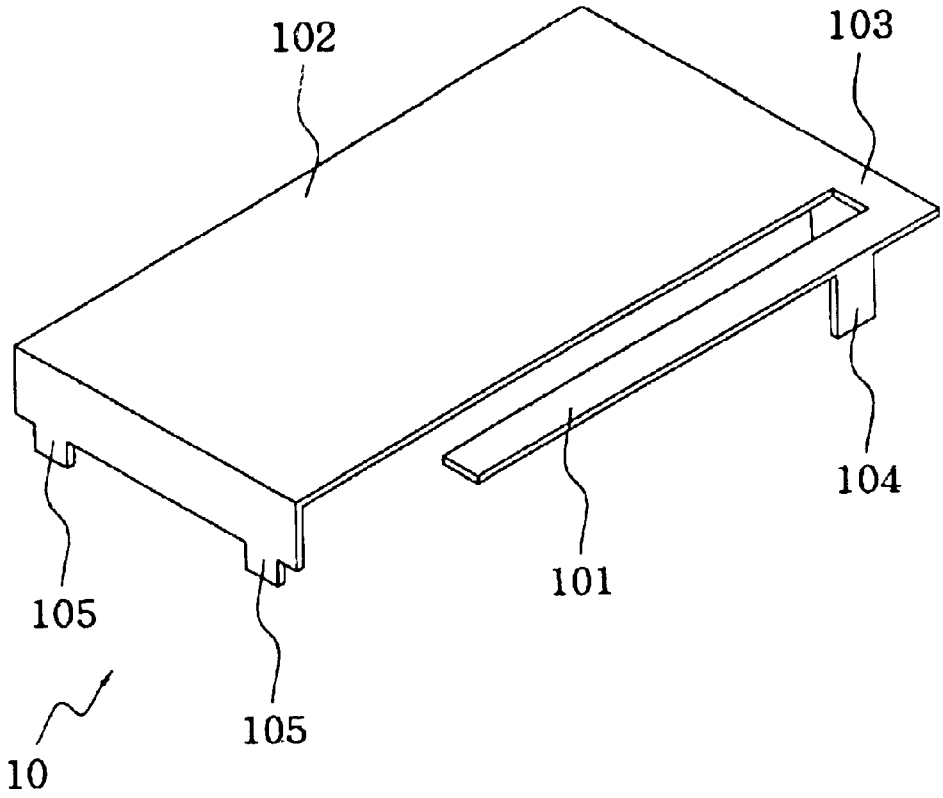
FIG. 1 illustrates the integral structure including an antenna and a shielding cover of the present invention.

In FIG. 1, an integral structure including an antenna and a shielding cover 10 comprises an antenna 101, a shielding cover 102, a first conducting plate 103, a second conducting plate 104 and four feet 105, the antenna 101 being elongated, and one end of the antenna 101 being connected to the side of one end of the shielding cover 102 by the first conducting plate 103. The antenna 101 is approximately parallel to the neighboring side of the shielding cover 102 in the longitudinal direction of the antenna 101, and the gap between them is 1.5 to 2.5 mm. In other words, the surface of antenna 101 in the longitudinal direction is approximately parallel to the surface of the shielding cover 102. The antenna 101 is used for signal transmitting and receiving, and the shielding cover 102 can avoid electromagnetic interferences and leakages. One end of the second conducting plate 104 is connected to the feed-in point of the antenna 101, the other end of that is connected to a printed circuit board of a wireless communication product for signal transferring. The four feet 105 connected to the shielding cover 102 is soldered to the printed circuit board as groundings. Therefore, the charges accumulated on the antenna 101 can be grounded by the path of the first conducting plate 103, the shielding cover 102 and the feet 105 to constrain EMI and acquire better radiation pattern.

Figure 2A:
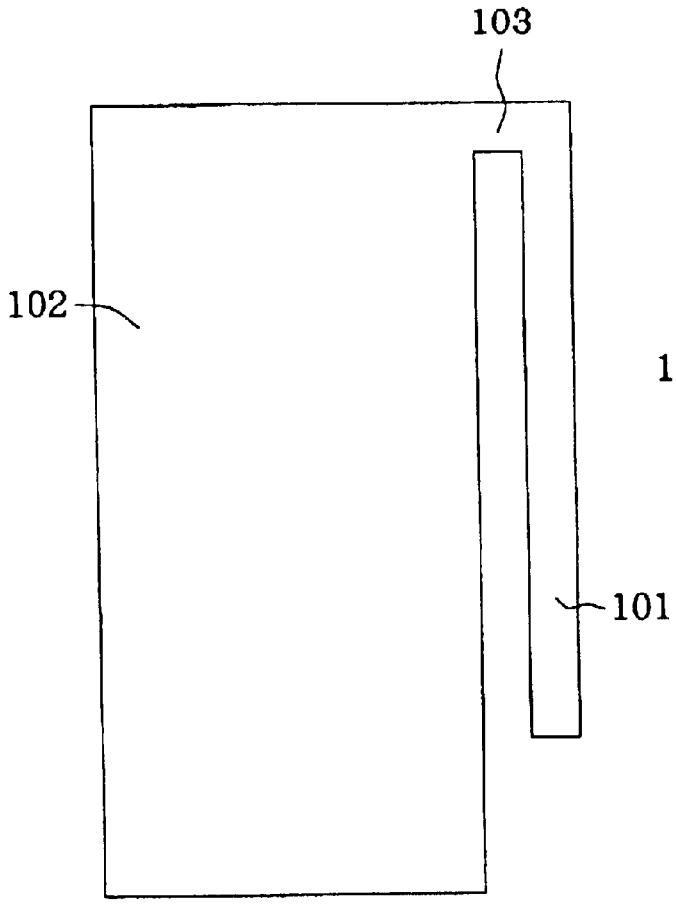
FIG. 2(*a*) to FIG. 2(*c*) respectively illustrate the top view, the front view and the side view of the integral structure including an antenna and a shielding cover of the present invention.
Figure 2C:
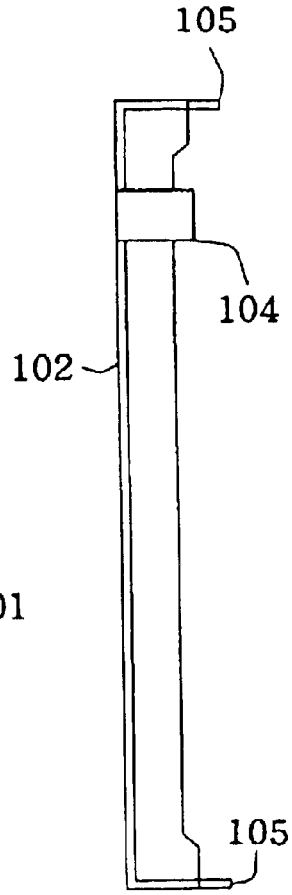
Figure 2B:
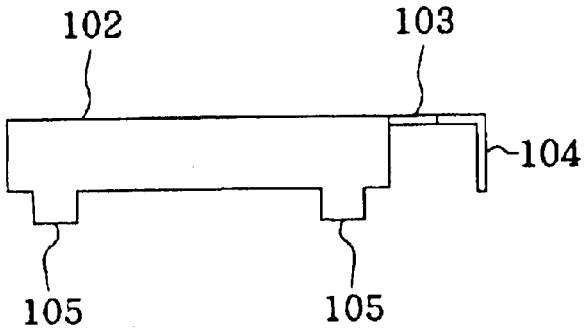

FIG. 2(*a*), FIG. 2(*b*) and FIG. 2(*c*) respectively illustrate the top view, the front view and the right-hand side view of the integral structure including an antenna and a shielding cover 10, showing the details of the integral structure including an antenna and a shielding cover 10 and the connecting manner of its components. The length of the suspended end of the antenna 101 to the signal feed-in point of antenna 101, i.e., the effective antenna length, is between 20 to 24 mm, and the width of the antenna 101 is between 1.5 to 2.5 mm. The antenna 101 can also utilize various frequencies by adjusting the dimensions. For instance, the effective length of the antenna 101 can be shortened to meet the 5 GHz band of the gradually matured 802.11a protocol. As usual, the shielding cover 102 has to fit the area of the printed circuit board, i.e., the shielding cover 102 has to cover the circuitry of the printed circuit board.

The integral structure including an antenna and a shielding cover 10 may be integrally formed by tinplate or a copper-electroplated tin plate, whose thickness is usually less than 0.5 mm.

Because the antenna 101 and the shielding cover 102 can be integrally formed by a metal plate, the cost can be reduced. Additionally, the antenna of the integral structure including an antenna and a shielding cover 10 can be built in a wireless product to avoid EMI, and the disadvantages of an exterior antenna thus can be overcome to meet the requirement of downsizing electronic products.

Besides being directly installed in a wireless product, the integral structure including an antenna and a shielding cover 10 can be equipped on a printed circuit board and a plug as a module first, and then the module can be connected to an interface of a wireless product for signal transferring.

Figure 3:
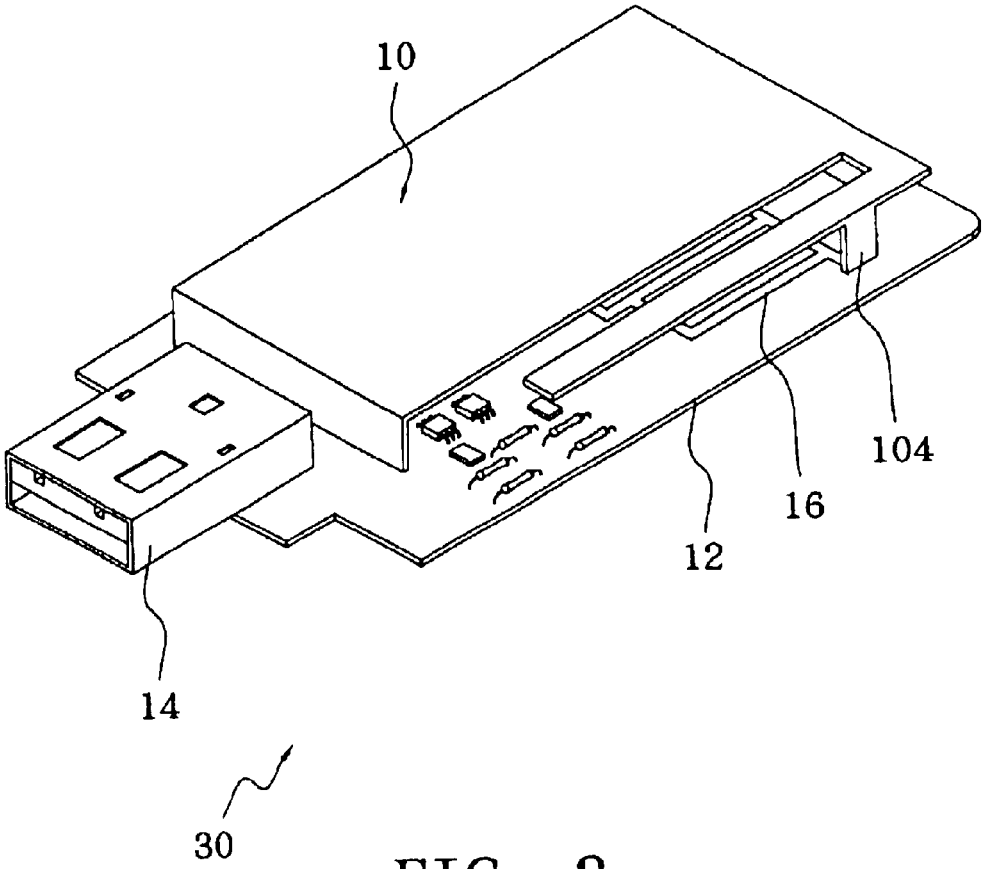
FIG. 3 illustrates the wireless communication module of the present invention.

Referring to FIG. 1 and FIG. 3, the feet 105 of the integral structure including an antenna and a shielding cover 10 are soldered to a printed circuit board 12, and one end of the second conducting plate 104 is electrically connected to a circuitry 16 of the printed circuit board 12. Thus, the antenna 101 is also electrically connected to the circuitry 16 to transfer signals. Furthermore, one end of the printed circuit board 12 is equipped with a plug 14 such as USB, IDE (Integrated Drive Electronics) and IEEE 1394 types to form a wireless module 30. After adequately packaging the wireless module 30, the wireless module 30 can be plugged into an interface of a notebook or a desktop computer for WLAN communication.

Figure 4:
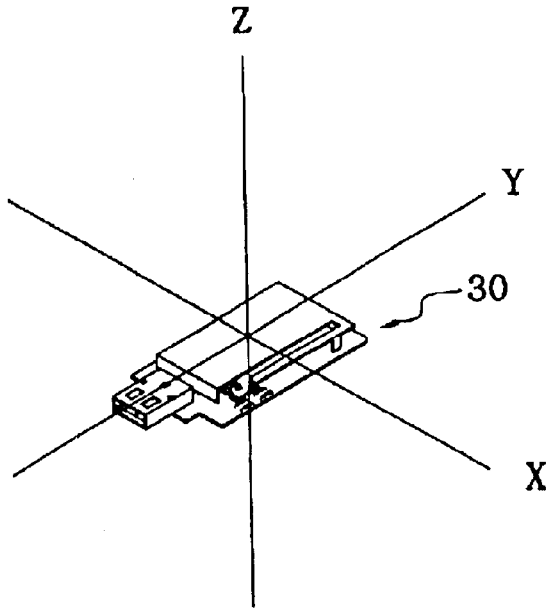
FIG. 4 illustrates the coordinates of the radiation pattern testing of the integral structure including an antenna and a shielding cover of the present invention.
Figure 5A:
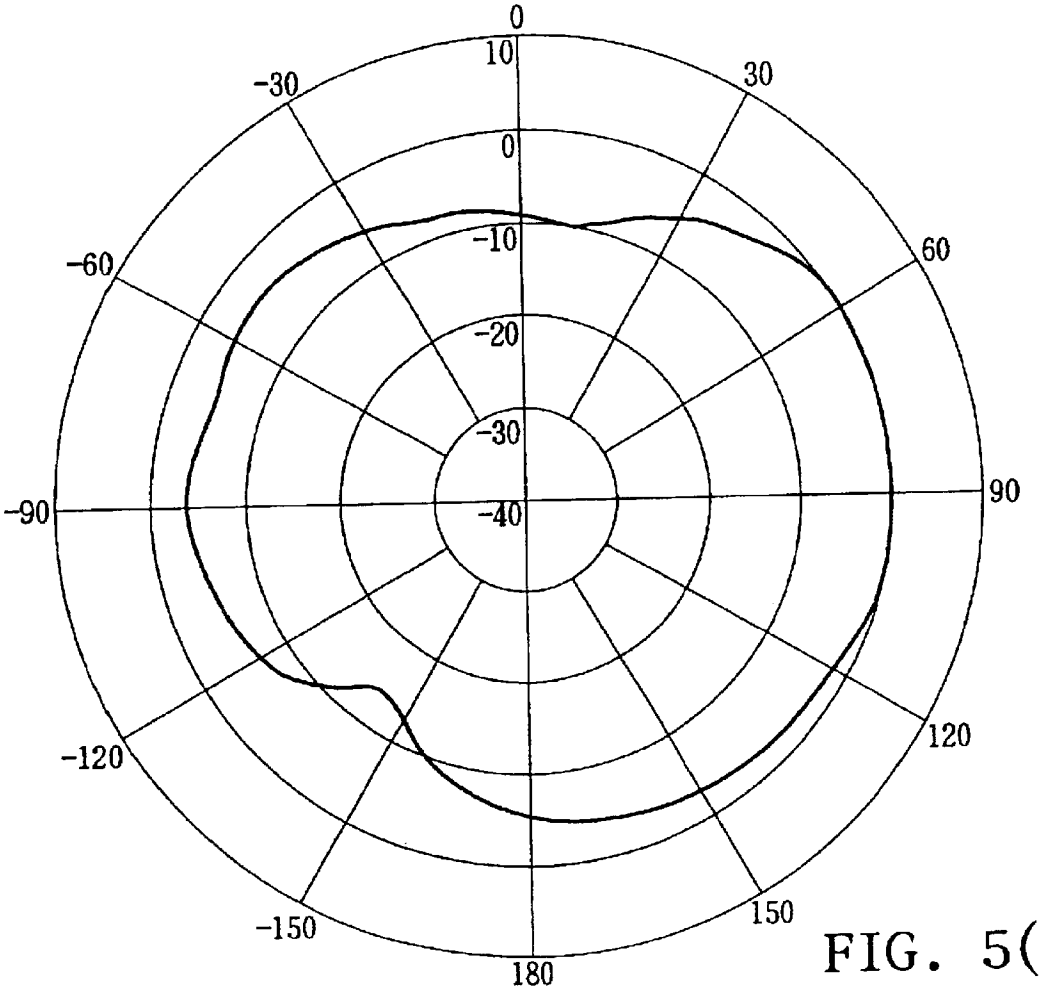
FIG. 5(*a*) to FIG. 5(*c*) illustrate the radiation patterns of the integral structure including an antenna and a shielding cover of the present invention.
Figure 5B:
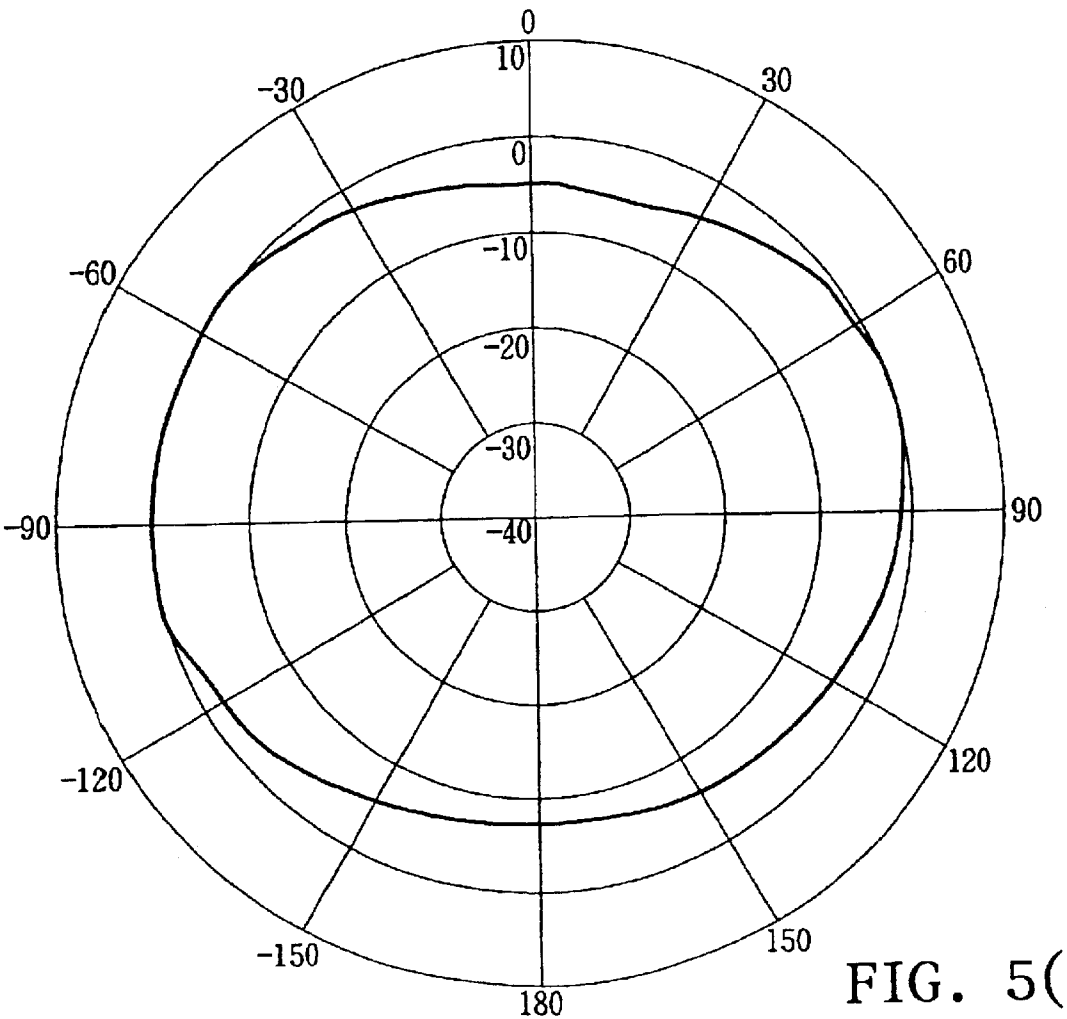
Figure 5C:
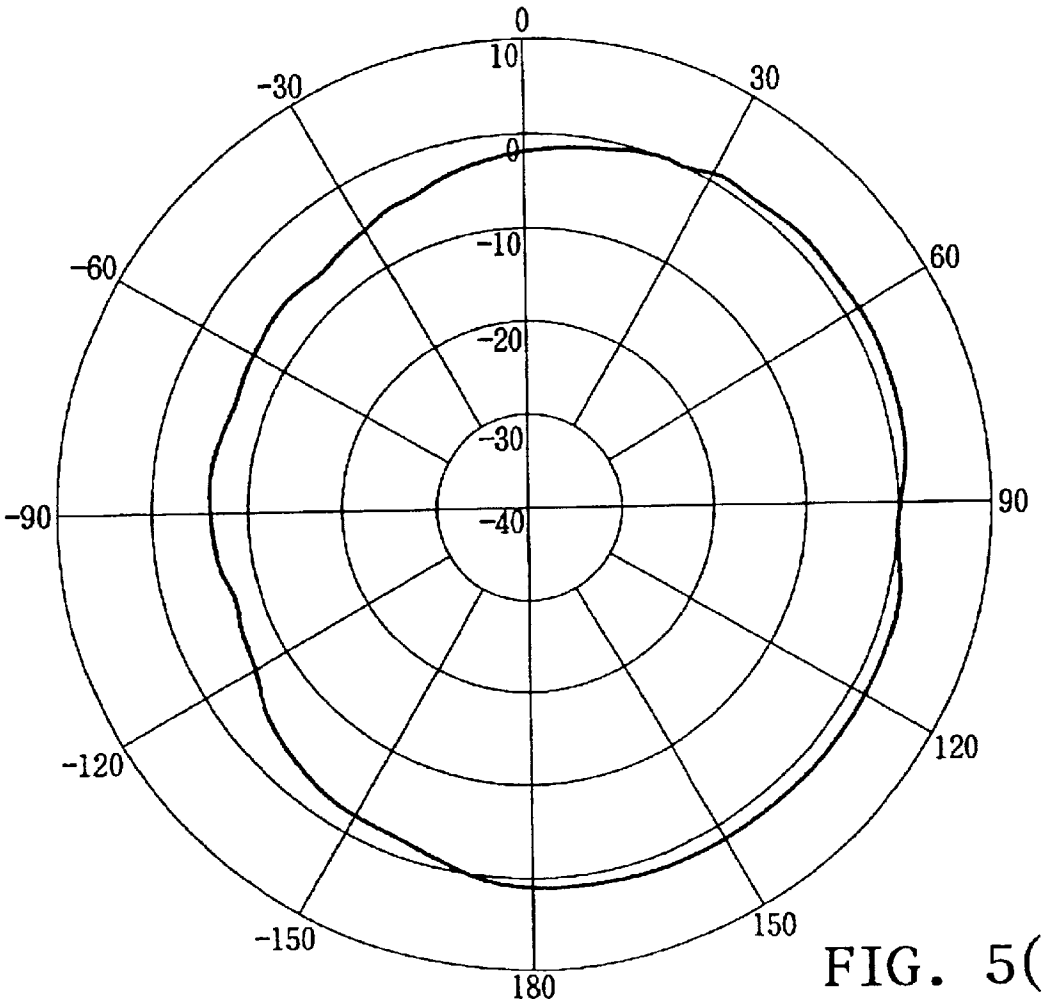

The coordinates of the radiation pattern testing of the wireless module 30 are shown in FIG. 4. In the case of 2.4 GHz, the electromagnetic field radiation patterns of X-Y, Y-Z and X-Z planes are respectively shown in FIG. 5(*a*), FIG. 5(*b*) and FIG. 5(*c*), and the unit of electromagnetic field is dBi.

As a result, the radiation intensities of the wireless module 30 at various angles are uniform and all figures show omni-directional radiation patterns, i.e., excellent spatial signal transferring can be obtained at various directions.

Besides being applied to computers, the integral structure including an antenna and a shielding cover and its wireless module of the present invention may be implemented in other wireless product such as presently popular IA products.

The above-described embodiment of the present invention are intended to be illustrative only. Numerous alternative embodiments may be devised by those skilled in the art without departing from the scope of the following claims.

What is claimed is:

1. An integral structure including an antenna and a shielding cover for a wireless product, comprising:

a shielding cover for avoiding electromagnetic interferences;

a rectangular antenna longitudinally spaced from the shielding cover by a distance, and the antenna being approximately parallel to the neighboring side of the shielding cover in the longitudinal direction of the antenna; and a first conducting plate for connecting the antenna and the shielding cover, wherein the effective length of the antenna is between 20 and 24 millimeters, and the distance between the antenna and the shielding cover is between 1.5 and 2.5 millimeters.

2. The integral structure including an antenna and a shielding cover of claim 1, wherein the shielding cover further comprises feet connected to a printed circuit board of the wireless product for grounding.

3. The integral structure including an antenna and a shielding cover of claim 1, further comprising a second conducting plate which connects the antenna and a printed circuit board of the wireless product.

4. The integral structure including an antenna and a shielding cover of claim 1, wherein the first conducting plate connects the ends of the antenna and the shielding cover.

5. The integral structure including an antenna and a shielding cover of claim 1, wherein the width of the antenna is between 1.5 to 2.5 mm.

6. The integral structure including an antenna and a shielding cover of claim 1, which is made by one of tinplate and copper-electroplated tin.

7. The integral structure including an antenna and a shielding cover of claim 1, wherein the shielding cover, the antenna and the first conducting plate are formed integrally.

8. A wireless module, comprising:

a printed circuit board;

an integral structure including an antenna and a shielding cover of claim 1, which is soldered to the printed circuit board; and a plug equipped on the printed circuit board.

9. The wireless module of claim 8, wherein the plug is used for USB interface.

10. The wireless module of claim 8, wherein the antenna is electrically connected to the printed circuit board.

11. The wireless module of claim 8, which uses 2.4 GHz frequency band.

12. The wireless module of claim 8, which uses Bluetooth technique to transfer signals.

13. An integral structure including an antenna and a shielding cover for a wireless product, comprising:

a shielding cover for avoiding electromagnetic interferences;

a rectangular antenna spaced from the shielding cover by a distance, and the longitudinal surface of the antenna being approximately parallel to the surface of the shielding cover; and a first conducting plate for connecting the antenna and the shielding cover, wherein the effective length of the antenna is between 20 and 24 millimeters, and the distance between the antenna and the shielding cover is between 1.5 and 2.5 millimeters.

14. The integral structure including an antenna and a shielding cover of claim 13, wherein the shielding cover further comprises feet connected to a printed circuit board of the wireless product for grounding.

15. The integral structure including an antenna and a shielding cover of claim 13, further comprising a second conducting plate for connecting the antenna and a printed circuit board of the wireless product.

16. The integral structure including an antenna and a shielding cover of claim 13, wherein the first conducting plate connects the ends of the antenna and the shielding cover.

17. The integral structure including an antenna and a shielding cover of claim 13, wherein the shielding cover, the antenna and the first conducting plate are formed integrally.

* * * * *